US009749755B2

(12) United States Patent
Udesen

(10) Patent No.: US 9,749,755 B2
(45) Date of Patent: Aug. 29, 2017

(54) HEARING DEVICE WITH SOUND SOURCE LOCALIZATION AND RELATED METHOD

(71) Applicant: GN Hearing A/S, Ballerup (DK)

(72) Inventor: Jesper Udesen, Malov (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 14/589,497

(22) Filed: Jan. 5, 2015

(65) Prior Publication Data

US 2016/0192088 A1 Jun. 30, 2016

(30) Foreign Application Priority Data

Dec. 29, 2014 (DK) ..... 2014 70832
Dec. 29, 2014 (EP) ..... 14200405

(51) Int. Cl.
*H04R 25/00* (2006.01)

(52) U.S. Cl.
CPC ..... *H04R 25/405* (2013.01); *H04R 25/407* (2013.01); *H04R 25/505* (2013.01); *H04R 25/552* (2013.01); *H04R 25/554* (2013.01); *H04R 2420/07* (2013.01)

(58) Field of Classification Search
CPC .... H04R 25/405; H04R 25/505; H04R 25/00; H04R 25/555
See application file for complete search history.

(56) References Cited

U.S. PATENT DOCUMENTS

2004/0037442 A1* 2/2004 Nielsen ..... H04R 25/554 381/315
2004/0057591 A1 3/2004 Beck et al.
2006/0080087 A1* 4/2006 Vandali ..... A61N 1/36032 704/207
2010/0195836 A1 8/2010 Platz
2011/0142268 A1* 6/2011 Iwakuni ..... H04R 25/43 381/312
2012/0008809 A1* 1/2012 Vandali ..... A61N 1/36032 381/317
2012/0282976 A1 11/2012 Suhami
(Continued)

FOREIGN PATENT DOCUMENTS

EP 2 584 794 A1 4/2013
WO WO 2008/083712 A1 7/2008

OTHER PUBLICATIONS

Extended European Search Report dated Apr. 29, 2015, for corresponding EP Patent Application No. 14200405.0, 7 pages.
(Continued)

*Primary Examiner* — Tuan D Nguyen
(74) *Attorney, Agent, or Firm* — Vista IP Law Group, LLP

(57) ABSTRACT

A hearing device includes: a processing unit; a transceiver connected to the processing unit and being configured for outputting a transceiver output signal representative of a first audio signal to form a first input signal for the processing unit; and a microphone connected to the processing unit for converting a second audio signal into a microphone output signal to form a second input signal for the processing unit; wherein the processing unit is configured to: estimate a time shift between the microphone output signal and the transceiver output signal, determine a time delay based on the time shift, and use the time delay to obtain a summing signal.

25 Claims, 12 Drawing Sheets

(56) References Cited

U.S. PATENT DOCUMENTS

2013/0094683 A1* 4/2013 Hansen ..... G09B 21/04
381/309
2015/0043742 A1* 2/2015 Jensen ..... H04R 25/554
381/66

OTHER PUBLICATIONS

First Technical Examination dated Aug. 13, 2015, for corresponding Danish Patent Application No. PA 2014 70832, 6 pages.

* cited by examiner

HEARING DEVICE WITH SOUND SOURCE LOCALIZATION AND RELATED METHOD

RELATED APPLICATION DATA

This application claims priority to and the benefit of Danish Patent Application No. PA 2014 70832 filed on Dec. 29, 2014, pending, and European Patent Application No. 14200405.0 filed on Dec. 29, 2014, pending. The entire disclosures of both of the above applications are expressly incorporated by reference herein.

FIELD

The present disclosure relates to a hearing device and related method and in particular to a hearing device for provision of sound source localization of wireless sound sources, such as spouse microphones, and method for provision of sound source localization of wireless sound sources.

BACKGROUND

One of the problems with spouse microphone systems for hearing devices is the lack of localization cues in the microphone signal. If there is no intra-aural time difference (ITD) or intra-aural level difference (ILD) present in the spouse microphone signal, when it is presented to the user, the natural ability of the user's brain to localize the sounds will therefore not be present. The result is that the user cannot hear where the spouse microphone sound is coming from, which is a major drawback for the user of the hearing device.

SUMMARY

Thus there is a need for a hearing device and a method for facilitating localization of spouse microphones and other wireless sound sources. This is obtained by the present hearing device and method.

Disclosed is a hearing device comprising a processing unit, a transceiver connected to the processing unit and being configured for outputting a transceiver output signal representative of a first audio signal to form a first input signal for the processing unit, and a microphone or microphone unit connected to the processing unit for converting a second audio signal into a microphone output signal to form a second input signal for the processing unit. The processing unit is configured to estimate or measure a time shift or time lag between the microphone output signal and the transceiver output signal, the time shift being a property between the microphone output signal and the transceiver output signal. The processing unit is configured to determine or select a time delay based on the time shift. The processing unit may be configured to use the time delay to obtain or form a summing signal, e.g. a first summing signal. The processing unit may be configured to apply the time delay to an input signal, e.g. the first input signal or the second input signal, for the processing unit to form a first summing signal. The processing unit is configured to combine the first summing signal and a second summing signal. The second summing signal may be or may be based on an input signal, e.g. the first input signal or the second input signal, to the processing unit.

Also disclosed is a method of operating a hearing device, the hearing device comprising a processing unit, a transceiver connected to the processing unit, and a microphone connected to the processing unit. The method optionally comprises estimating or measuring a time shift, e.g. between a microphone output signal and a transceiver output signal. The method optionally comprises determining or selecting a time delay, e.g. based on the time shift. The method may comprise using the time delay to obtain or form a summing signal, e.g. a first summing signal. The method optionally comprises applying the time delay to an input signal e.g. the first input signal or the second input signal, to the processing unit, e.g. to form a first summing signal. The method optionally comprises combining the first summing signal and a second summing signal, e.g. where the second summing signal is based on an input signal, e.g. the first input signal or the second input signal, to the processing unit.

Also disclosed is a hearing device system comprising a first and a second hearing device, wherein the first hearing device is a hearing device according to the above and following exemplary hearing devices.

It is an advantage that the hearing device and method is able to compensate for possible hardware delays in both the hearing device and in the spouse microphone device.

A hearing device includes: a processing unit; a transceiver connected to the processing unit and being configured for outputting a transceiver output signal representative of a first audio signal to form a first input signal for the processing unit; and a microphone connected to the processing unit for converting a second audio signal into a microphone output signal to form a second input signal for the processing unit; wherein the processing unit is configured to: estimate a time shift between the microphone output signal and the transceiver output signal, determine a time delay based on the time shift, and use the time delay to obtain a summing signal.

Optionally, the processing unit is configured to obtain the summing signal by applying the time delay to the first input signal or the second input signal to form the summing signal; and wherein the processing unit is further configured to combine the summing signal with the first input signal or the second input signal.

Optionally, the processing unit is configured to combine the summing signal with the second input signal, not the first input signal.

Optionally, the processing unit is configured to apply the time delay to the first input signal, not the second input signal.

Optionally, the processing unit is configured to combine the summing signal with the first input signal, not the second input signal.

Optionally, the processing unit is configured to apply the time delay to the second input signal, not the first input signal.

Optionally, the processing unit is configured to apply the time delay to one of the first input signal and the second input signal, and wherein the processing unit is also configured to combine the summing signal with the other one of the first input signal and the second input signal.

Optionally, the processing unit is configured to form the summing signal by applying the time delay to an input signal received by the processing unit; and wherein the processing unit is further configured to combine the summing signal and an additional summing signal, the additional summing signal being based on another input signal received by the processing unit.

Optionally, a time shift between the first and the second summing signals is anywhere from 2 ms to 50 ms.

Optionally, the processing unit is configured to estimate the time shift between the microphone output signal and the transceiver output signal using cross correlation, summing of squared differences, summing of absolute differences, or any combination of the foregoing.

Optionally, the processing unit is configured to output the time shift between the microphone output signal and the transceiver output signal and/or the time delay for transmission to another hearing device.

Optionally, the processing unit is configured to estimate a first correlation coefficient corresponding to the time shift, and output the first correlation coefficient for transmission to another hearing device.

Optionally, the processing unit is configured to receive a time shift between input signals in another hearing device, and a second correlation coefficient corresponding to the time shift between the input signals in the other hearing device.

Optionally, the processing unit is configured to determine the time delay based on the time shift between the input signals in the other hearing device and the second correlation coefficient.

A hearing device system includes a first hearing device and a second hearing device, wherein the first hearing device is any of the hearing devices described herein.

A method of operating a hearing device, the hearing device comprising a processing unit, a transceiver connected to the processing unit, and a microphone connected to the processing unit, the method includes: estimating a time shift between a microphone output signal and a transceiver output signal; determining a time delay based on the time shift; and using the time delay to obtain a summing signal.

Other features, embodiments, and advantageous will be described below in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
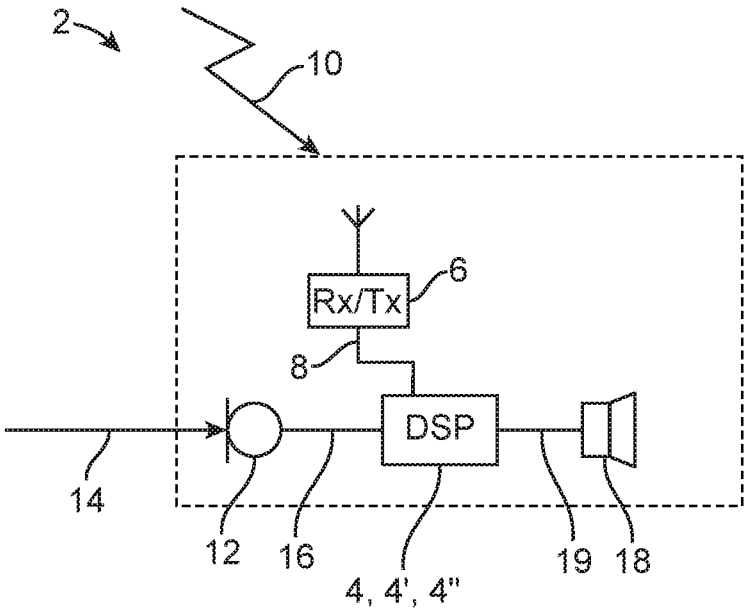
FIG. 1 schematically illustrates an exemplary hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

The disclosed hearing device may comprise a receiver connected to the processing unit for converting an output signal from the processing unit to an audio output signal.

The hearing device may be a hearing aid, e.g. the processing unit may be configured for hearing loss compensation of a user's hearing loss.

Additional to the processing performed by the processing unit, pre-processing of one or more of the audio signals may performed, and/or post-processing of one or more of the audio signals may be performed, such as e.g. applying a gain, performing filtering by filters, providing A/D conversion by an A/D converter etc.

Thus disclosed is an apparatus and method that provides localization of spouse microphones and other wireless sound sources and at the same time provides a high signal-to-noise ratio of speech from the person wearing the spouse microphone.

The hearing device comprises a transceiver that is configured for outputting a transceiver output signal representative of a first audio signal. The first audio signal may be a spouse microphone signal or other sound source signal. The transceiver may be configured to operate in the 2.4-2.5 GHz band. The transceiver may be a Bluetooth or Bluetooth Low Energy transceiver.

The hearing device comprises a microphone or microphone unit configured for converting a second audio signal into a microphone output signal which is the hearing aid microphone signal. The microphone output signal (second input signal) may comprise the natural intra-aural time difference (ITD) and intra-aural level difference (ILD) cues from the head geometry of the hearing aid user. However, the signal-to-noise ratio (SNR) in the microphone output signal is typically much lower than in the transceiver output signal, i.e. the spouse microphone signal. Furthermore, the microphone output signal is typically delayed, e.g. in the range from 0-30 ms due to a distance, d, between the hearing device worn by the user and the spouse microphone, or other wireless sound sources, providing the transceiver output signal. The microphone unit may comprise a plurality of microphones and/or a directional microphone. Accordingly, the second input signal may be a beamformed signal.

The processing unit is configured to estimate a time shift or time lag between the transceiver output signal (first input signal) and the microphone output signal (second input signal). Thus, the processing unit may comprise a time shift estimator. The time shift between the transceiver output signal (first input signal) and the microphone output signal (second input signal) is caused by the distance between the hearing device user and the spouse carrying the spouse microphone. Hardware delays in the spouse microphone and in the hearing device also contribute to or affect the time shift between the transceiver output signal (first input signal) and the microphone output signal (second input signal).

The processing unit is configured to determine or select a time delay based on the time shift $\Delta t$ between the transceiver output signal (first input signal) and the microphone output signal (second input signal). Hence, the processing unit may comprise a time delay selector. Thus the time delay is a function of the time shift. In an exemplary hearing device or method, the time delay(s) is/are determined such that a time shift $\Delta t'$ between the first and the second summing signals is within a desired range, such as in the range from 2 to 50 ms or in the range from 5 to 30 ms. To determine or select a time delay D based on the time shift Δt between the transceiver output signal (first input signal) and the microphone output signal (second input signal) may comprise to determine or select a first time delay D1 for the first input signal and a second time delay D2 for the second input signal based on the time shift Δt between the transceiver output signal (first input signal) and the microphone output signal (second input signal).

As used in this specification, the term "summing signal" refers to any signal, which may be obtained based on one or more input signals. The term "summing signal" does not imply or require that the summing signal is the result of or used for a summation unless otherwise stated.

The time delay is applied to one of the input signals, e.g. to the first input signal or to the second input signal. The input signal which the time delay is applied to is provided to the processing unit to form a first summing signal. The delay of the first input signal and/or the second input signal is performed such that the hearing device user will hear the second audio signals from the hearing aid microphones in some appropriate time before hearing the first audio signals from e.g. the spouse microphone. Thereby, the hearing device user will be able to locate the person using the spouse microphone using the localization cues in the second audio signal and at the same time obtain a high signal-to-noise ratio of the speech signal due to the so-called precedence effect. Accordingly, the processing unit may be configured to determine or select one or more time delays (and to which input signal the time delay(s) is/are applied to) such that a time shift between the first and second summing signals is within a desired range, such as in the range from 2 ms to 50 ms, and such that the summing signal based on the second input signal comes first, i.e. before the summing signal based on the first input signal, in order to take advantage of the precedence effect.

The second summing signal is based on an input signal to the processing unit. If only one of the input signals is delayed, the second summing signal is based on the input signal which the time delay is not applied to. Thus if a time delay is only applied to the first input signal, the second summing signal is based on the second input signal, and vice versa if a time delay is only applied to the second input signal, then the second summing signal is based on the first input signal. When both a first time delay and a second time delay is determined and/or applied, the first summing signal is based on the first input signal, and the second summing signal is based on the second input signal. Accordingly, the processing unit may comprise at least one delay unit, such as a first delay unit and/or a second delay unit. A single delay unit may be used with selective routing of the first and second input signals dependent on which input signal is to be delayed.

The first summing signal and the second summing signal are combined, e.g. by addition or weighted sum.

Assuming no hardware delay, the combined signal s3(*t*) is given by:

$$s3(t)=s1(t+t0)+s2(t-d/c),$$

where s1 is the transceiver output signal from the spouse microphone (first input signal), s2 is the microphone output signal from the hearing device (second input signal), d is the distance between the hearing device worn by the user and the spouse microphone and c is the speed of sound e.g. the speed of sound in air at sea level i.e. approximately 340 m/s. Now t0 should be adjusted such that t0=d/c+t1, and t1 should be within a desired range, such as in the range between 2 ms and 50 ms.

The combined signal s3(*t*) is used for hearing device processing and the processed signal is presented to the user in the hearing device. The result is that the user will hear the audio signals from the hearing aid microphone(s) some millisecond before, such as 2-50 ms before, the audio signals from the spouse microphone(s), thus maintaining localization with an improved signal-to-noise ratio.

The method is based on the precedence effect, also called the law of the first wavefront or Haas effect and is a binaural psychoacoustic effect. When a sound is followed by another sound separated by a sufficiently short time delay, i.e. below the listener's echo threshold, the listener perceive a single fused auditory image; its perceived spatial location is dominated by the location of the first-arriving sound, i.e. the first wave front. The lagging sound also affects the perceived location. However, its effect is suppressed by the first-arriving sound.

Thus in the present hearing device and method, the hearing device user's brain uses the ILD and ITD cues in the first arriving wave front, which is from the hearing aid microphones (second input signal), to localize the sound. The part of the signal from the spouse microphones, i.e. the transceiver output signal (first input signal), is used to improve the signal-to-noise ratio (SNR), but the brain has the ability not to use the lack of localization cues from the first input signal when it is delayed compared to the second input signal. However, the improved SNR in the transceiver output signal from the spouse microphone is still used by the brain.

It is an advantage that the user will experience a much more natural sound environment when using the audio signals from the spouse microphone. The natural localization cues will be presented to the user and the high SNR from the spouse microphone will be maintained.

Thus the hearing device user receives the sound, typically talk or speech, from the spouse both from the hearing device microphone(s) (second input signal) and from the spouse microphone (first input signal) in the form of the transceiver connected to the processing unit and being configured for outputting a transceiver output signal representative of a first audio signal to form a first input signal. The spouse microphone providing the first input signal is configured to be arranged on, such as worn by the spouse, or at, such as placed on a table in front of the spouse. The spouse microphone providing the first input signal may be a directional microphone, and thus the spouse microphone will typically receive and transmit the sound mainly from the spouse and substantially not transmit sound from the surroundings.

The hearing device microphone (second input signal) will typically capture sounds from the surroundings, including the sound from the spouse, which is also transmitted to the hearing device as the first audio signal.

The term spouse microphone is used here as a term to refer to a microphone, typically a directional microphone, which is arranged distant from the hearing device worn by the hearing device user, i.e. the spouse microphone is not arranged in the hearing device. The spouse microphone will typically be worn by a spouse to the hearing device user, or be placed on a surface, such as table in front of the spouse for capturing the sounds, e.g. voice, sounds, speech or talk from the spouse, to be transmitted wirelessly to the hearing device of the hearing device user. The person whose sounds or voice is captured by the spouse microphone may be a spouse to the hearing device user, a family member, a friend, a colleague, a business partner etc., i.e. any person which the hearing device user wishes to clearly hear the sounds e.g. talk from, e.g. in an environment with many sounds, such as in a restaurant, in an office facility, at home, in a garden etc.

As understood from the above, the transceiver output signal representative of a first audio signal is not limited to a spouse microphone signal, but may be any, e.g. wireless, microphone signal, thus the first audio signal may be any audio signal.

The first input signal or the second input signal may be received first in the processing unit of the hearing device. The other input signal, i.e. the first input signal or the second input signal, may be received subsequently, such as 1 ms, 2 ms, 5 ms, 10 ms, 15 ms, 20 ms, 25 ms, 30 ms, or 35 ms later depending on the distance to the spouse microphone and hardware delays.

The processing unit may be configured to determine which of the first input signal and the second input signal, the time delay should be applied to.

The processing unit may be configured to determine which of the first input signal and the second input signal the time delay should be applied to based on which of the first input signal and the second input signal are received first. Typically, the first input signal (transceiver output signal) is received first in the hearing device (processing unit), i.e. before the second input signal, as the second input signal typically is delayed, such as delayed 0-30 ms, due to the distance between the hearing device user and the spouse wearing the spouse microphone. A processing unit configured to apply time delay to the second input signal may be preferred since situations may arise where the second input signal arrives too early in time before the first input signal to take advantage of the precedence effect. A processing unit configured to apply time delay to both the first and second input signal may be preferred to provide a high degree of freedom in order to provide a combined signal with localization cues and a large signal to noise ratio. A processing unit configured to apply time delay to both the first and second input signal may be preferred for a binaural hearing device system in order to provide and maintain localization in all listening situations. For example, hardware delays in a first hearing device may require that the microphone signal (second input signal) is delayed with a second delay. However, in order to maintain localization (interaural time difference, ITD) it is required to be able to apply a second delay to the microphone input (second input signal) in the second hearing device of the binaural hearing device system.

The processing unit may be configured to apply the determined time delay to an input signal to the processing unit to form a first summing signal. The time delay may be applied to the first input signal or the time delay may be applied to the second input signal. The processing unit may be configured to apply a first time delay to the first input signal and/or a second time delay to the second input signal. Hence, the processing unit may comprise a first time delay unit and/or a second time delay unit. The first time delay unit and the second time delay unit may be embedded as a time delay unit in a combined time delay selector and time delay unit.

The processing unit may be configured to combine, such as adding or linearly combining, the first summing signal and a second summing signal. Hence, the processing unit may comprise a combiner, such as an adder or weighted sum unit. The second summing signal may be based on an input signal to the processing unit, i.e. the second summing signal may be based on the first input signal or on the second input signal. The second summing signal may be the second input signal, e.g. when only the first input signal is delayed. The second summing signal may be the first input signal, e.g. when only the second input signal is delayed. The second input signal may be delayed when the time shift between the first and second input signals is too large to take suitable advantage of the precedence effect, e.g. if the speaker is close to the hearing device wearer and the hardware delays in the spouse microphone and the transceiver are significant, such that the second input signal is received too early.

When a time delay is applied to the first input signal, then the second summing signal may be based on the second input signal.

When a time delay is applied to the second input signal, e.g. with no time delay applied to the first input signal, the second summing signal may be based on the first input signal.

The time delay may be selected such that a time shift between the first and the second summing signals is between 2 ms and 50 ms, such as between 5-10 ms, such as between 5-15 ms, such as between 5-20 ms, such as between 10-20 ms, such as between 15-25 ms, such as between 20-30 ms, such as between 30-40 ms, such as between 40-50 ms. This time shift or time lag between the two summing signals is performed such that the hearing device user will hear the second audio signals from the hearing aid microphones in some appropriate time before hearing the first audio signals from e.g. the spouse microphone, i.e. for providing the precedence effect. In one or more exemplary hearing devices, the time delay may be selected such that a time shift between the first and the second summing signals is between 5 ms and 30 ms.

The time shift between the transceiver output signal (first input signal) and the microphone output signal (second input signal) may be estimated using at least one of cross correlation, summing of squared differences and summing of absolute differences. The cross correlation, the summing of squared differences and the summing of absolute differences may be termed time shift estimators. In the cross correlation and/or in the summing of squared differences and/or in the summing of absolute differences signals may be multiplied, added, subtracted, divided etc.

If the difference in amplitude between two input signals in e.g. the cross correlation is large, then the cross correlation may not be optimal. Accordingly, the processing unit (time shift estimator) may therefore be configured to normalise one or more of the input signals before and/or after the cross correlation in order to obtain signals with a similar amplitude, thereby providing an optimal cross correlation.

The processing unit may be configured to transmit time shift between the transceiver output signal (first input signal) and the microphone output signal (second input signal). The processing unit may be configured to transmit time delay(s) based on the time shift between the microphone output signal (second input signal) and the transceiver output signal (first input signal) and/or which input signal(s) the time delay(s) is/are applied to another hearing device. The other hearing device may be a hearing device in the other ear of the user, i.e. when the user wears a hearing device in both ears, i.e. a binaural hearing device system. Thereby an effective binaural processing is facilitated by enabling the hearing devices of the binaural hearing device system to maintain localization cues, in particular if the second input signal is delayed.

The processing unit may be configured to estimate a first correlation coefficient corresponding to the time shift. The first correlation coefficient may be the correlation value at the time shift. The processing unit may be configured to transmit the first correlation coefficient to another hearing device. Thus the first correlation coefficient may be estimated in the hearing device and then transmitted to the other hearing device, e.g. the hearing device in the user's other ear.

The processing unit may be configured to receive a time shift between input signals in another hearing device and/or a second correlation coefficient corresponding to the time shift between input signals in the other hearing device. The second correlation coefficient may be the correlation value at the time shift between input signals in the other hearing device. The processing unit may be configured to receive one or more time delays from another hearing device.

The processing unit may receive the time shift between input signals in the other hearing device and/or the second correlation coefficient from the other hearing device, e.g. from a hearing device in the user's other ear. Alternatively, and/or additionally, the processing unit may receive the time shift between input signals in the other hearing device and/or the second correlation coefficient from a smart phone and/or the like. The smart phone may be wirelessly connected with both hearing devices in a binaural hearing device system, and the smart phone may be configured for transmitting and/or receiving time shifts, e.g. a first and second time shift, and/or correlation coefficients, e.g. a first and a second correlation coefficient, to and/or from the two hearing devices in a binaural hearing device system.

The processing unit may be configured to determine or select time delay(s) based on the time shift of the other hearing device, time delay(s) of the other hearing device, and/or second correlation coefficient from the other hearing device, and apply the determined time delay(s) to the input signal(s). The time delay may correspond to the estimated time shift corresponding to the hearing device with the highest correlation coefficient. Applying this time delay may provide the best signal-to-noise ratio and thus the best final audio signal in the binaural hearing device system to the user.

The processing unit may be configured to determine time delay(s) based on the time shift between input signals in the other hearing device and/or the second correlation coefficient. The time delay(s) of the hearing device may then be applied to input signal(s) to the processing unit, e.g. to form the first summing signal.

The processing unit in the hearing device may be configured to determine and apply time delay(s) at a fixed or variable frequency. For example the time delays may be determined and/or updated at an update frequency of 1 Hz or less. A suitable update frequency may be in the range from 0.1 Hz-10 Hz, such as in the range from 0.5 Hz to 2 Hz, e.g. 1 Hz, e.g. in order to balance the requirement to adapt to changing input signals (change in position) and the limited power resources of a hearing device. Additionally or alternatively, the time delays may be adjusted based on a user input or an update criterion and/or an update event e.g. from another hearing device. The processing unit may be configured to determine whether the time delay changes more than a threshold value, and optionally apply updated time delay(s), if the change(s) in time delay(s) meets an update criterion, e.g. if the change in the time delay applied is larger than the threshold value. An algorithmic processing of the processing unit may overrule the change and/or update in time delay, e.g. if the time delay changes more than the predetermined threshold value, as this would, possibly erroneously be perceived by the hearing device user as, if the spouse wearing the spouse microphone providing the transceiver output signal (first input signal) moves too much too fast. Thus the first audio signal and the second audio signal would then be out of synchronization and this is not optimal for the hearing device user to listen to.

FIG. 1 schematically illustrates an exemplary hearing device for provision of sound source localization of wireless sound sources. The hearing device is configured to add localization cues to a first audio signal, such as a spouse microphone signal by application of suitable delay(s) to one or more input signals. The hearing device 2 comprises a processing unit 4, 4', 4" a transceiver 6 connected to the processing unit 4, 4', 4" and being configured for outputting a transceiver output signal 8 representative of a first audio signal 10 to form a first input signal to the processing unit 4, 4', 4". The first audio signal 10 is a wireless audio signal. The hearing device 2 comprises a microphone 12 connected to the processing unit 4 for converting a second audio signal 14 into a microphone output signal 16 to form a second input signal to the processing unit 4. The second audio signal 14 is an acoustic signal. The processing unit 4, 4', 4" is configured to estimate a time shift between the microphone output signal 16 and the transceiver output signal 8 and/or which of the microphone output signal 16 and the transceiver output signal is first in time. The processing unit 4, 4', 4" is configured to determine one or more time delays, e.g. a first time delay and/or a second time delay, based on the time shift, and the processing unit 4, 4', 4" is configured to apply the determined time delay(s) to the first input signal and/or to the second input signal to the processing unit 4, 4', 4". The processing unit 4, 4', 4" is configured to form a first summing signal and a second summing signal and to combine the first summing signal and the second summing signal. The second summing signal may, e.g. in case of a delay only being applied to one of the input signals, be based at least on the other input signal, i.e. the input signal of the first or the second input signal to which the time delay was not applied. Thus if the time delay is applied to the first input signal (denoted first time delay), the second summing signal is based on the second input signal. If the time delay is applied to the second input signal (denoted second time delay), the second summing signal is based on the first input signal.

Optionally, the hearing device 2 comprises a receiver 18, such as an output transducer, a loudspeaker or speaker, connected to the processing unit 4, 4', 4" for outputting an output signal 19 of the processing unit (processed first and second audio signals) into the ear of the hearing device user. The combined signal comprising the first summing signal and the second summing signal may be processed further by the processing unit 4, 4', 4" before being outputted or transmitted through the transducer 18, such as processed to apply a gain to the combined signal, such as processed to compensate the combined signal for the hearing loss specific for the hearing device user etc.

Figure 2:
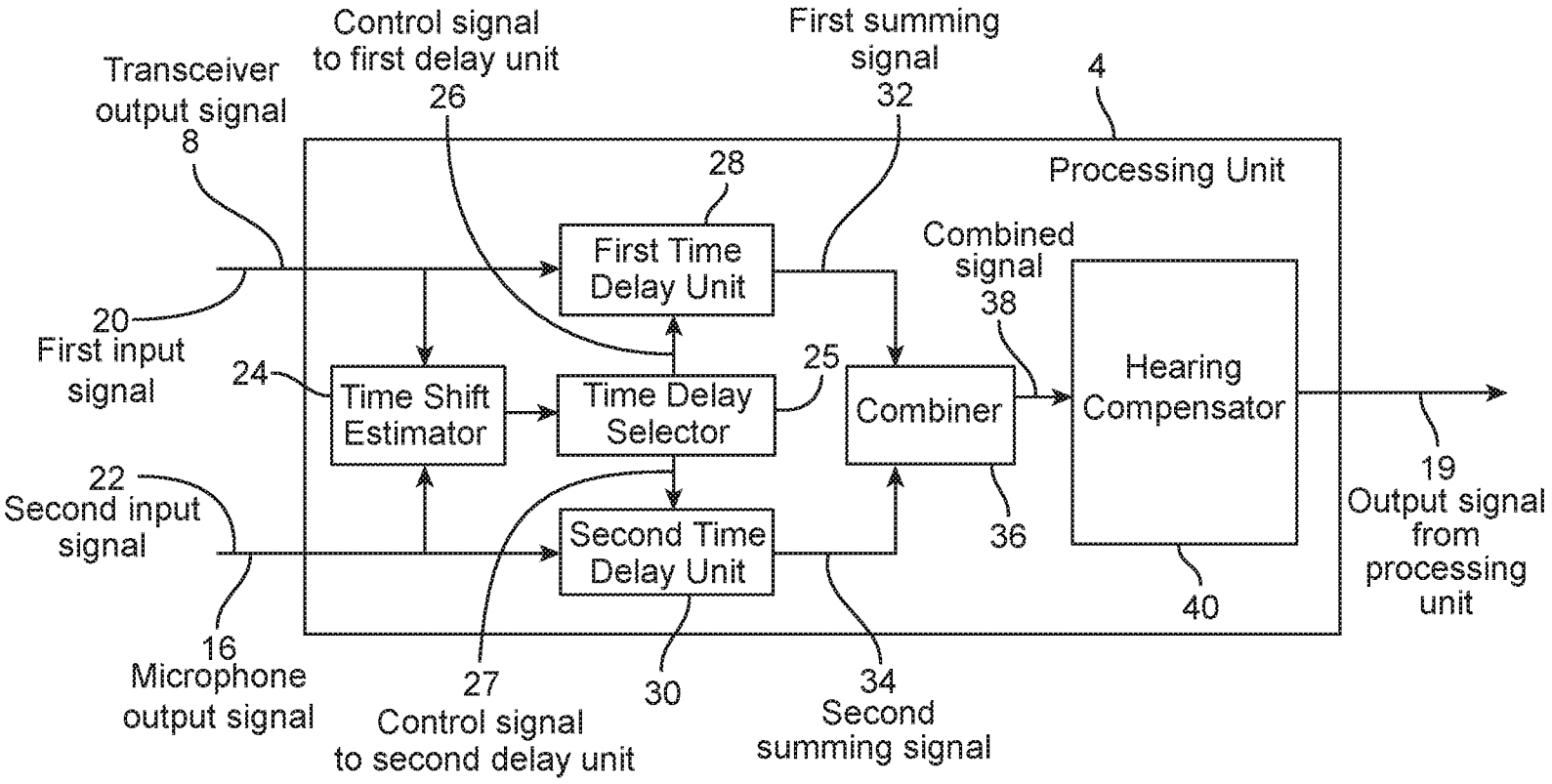
FIG. 2 schematically illustrates an exemplary processing unit.

FIG. 2 schematically illustrates an exemplary processing unit 4 of a hearing device for provision of sound source localization of wireless sound sources. A transceiver output signal 8 representative of a first audio signal forms a first input signal 20 to the processing unit 4. A microphone output signal 16 representative of a second audio signal forms a second input signal 22 to the processing unit 4. A time shift estimator 24 is configured to estimate a time shift between the microphone output signal 16/second input signal 22 and the transceiver output signal 8/first input signal 20. Estimating the time shift with the time shift estimator 24 comprises using at least one of cross correlation, summing of squared differences and summing of absolute differences.

The processing unit comprises a time delay selector 25 connected to the time shift estimator and being configured to select or determine one or more time delays to be used in delay unit(s) 28, 30 of the processing unit. In the processing unit 4, a first time delay unit 28 is configured to apply a first time delay to the first input signal depending on a control signal 26 indicative of first time delay from the time delay selector. Optionally, a second time delay unit 30 is configured to apply a second time delay to the second input signal depending on a control signal 27 indicative of second time delay from the time delay selector. The first time delay unit 28 outputs a first summing signal 32 based on the first input signal 20 and the control signal 26. The second time delay unit 30 outputs a second summing signal 34 based on the second input signal 22 and the control signal 27. In a processing unit without the second time delay unit 30 (see e.g. FIG. 3), the second input signal 22 may constitute the second summing signal 34.

The processing unit 4 comprises a combiner 36 in the form of an adder or weighted sum unit. The combiner 36 adds the first summing signal 32 and the second summing signal 34 to form a combined signal 38. The combined signal 38 is then fed to the hearing compensator 40 for hearing aid compensation of the combined signal 38. In an exemplary hearing device, the hearing compensator 40 may compensate the combined signal 38 according to a hearing loss of a user of the hearing device 2.

Figure 3:
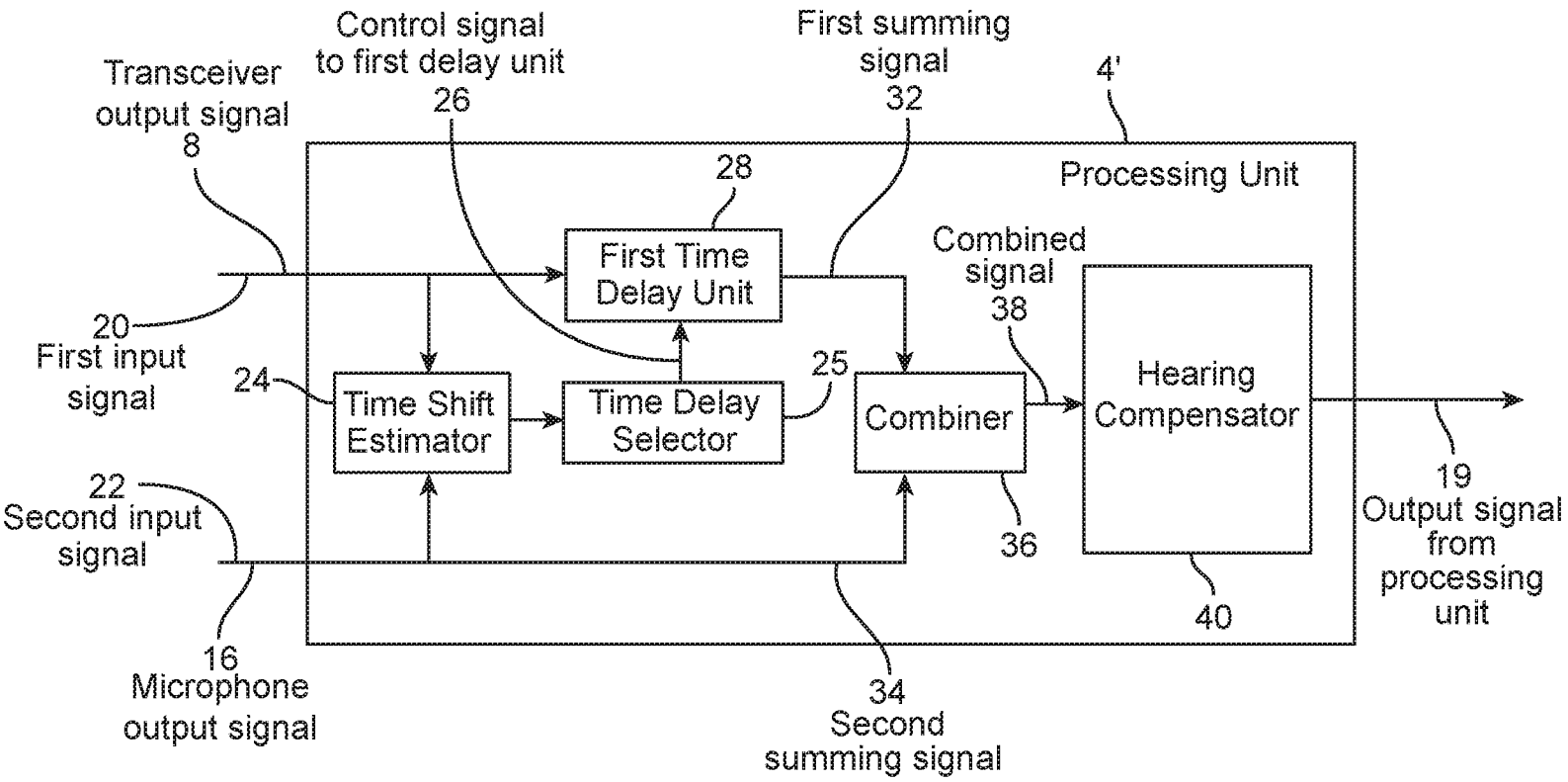
FIG. 3 schematically illustrates an exemplary processing unit.

FIG. 3 schematically illustrates an exemplary processing unit 4' of a hearing device for provision of sound source localization of wireless sound sources. The processing unit 4' feeds the second input signal 22 to the combiner 36. Accordingly, the second input signal is the second summing signal 34. The first time delay applied in the first time delay unit 28 may be zero.

Figure 4:
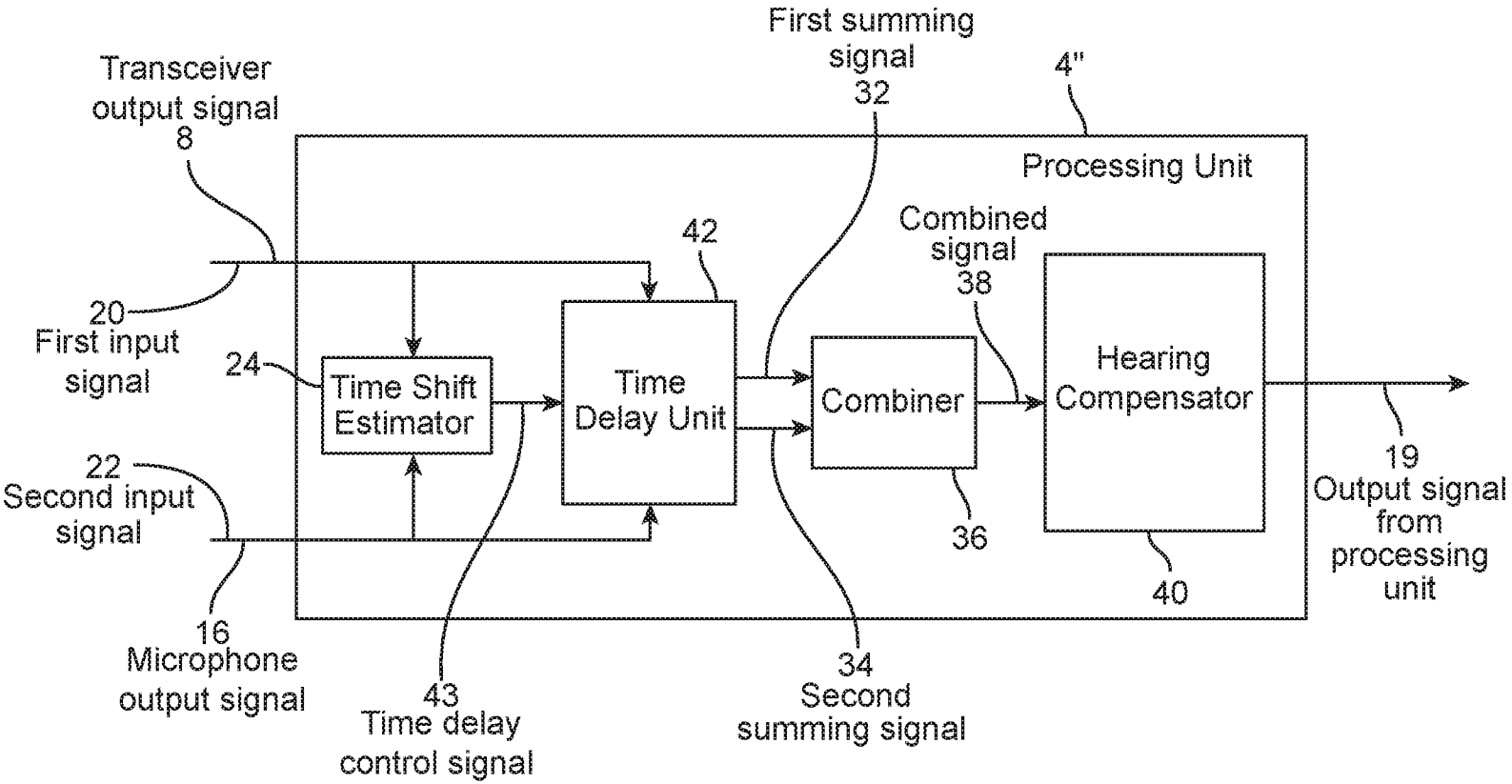
FIG. 4 schematically illustrates an exemplary processing unit.

FIG. 4 schematically illustrates an exemplary processing unit 4" of a hearing device for provision of sound source localization of wireless sound sources. The processing unit 4" comprises a combined time delay selector and time delay unit 42. The combined time delay selector and time delay unit 42 selectively applies a time delay to the first input signal or the second input signal based on time delay control signal 43 from the time shift estimator 24 to form the first summing signal 32. The input signal which is not to be delayed forms the second summing signal 34.

Figure 5:
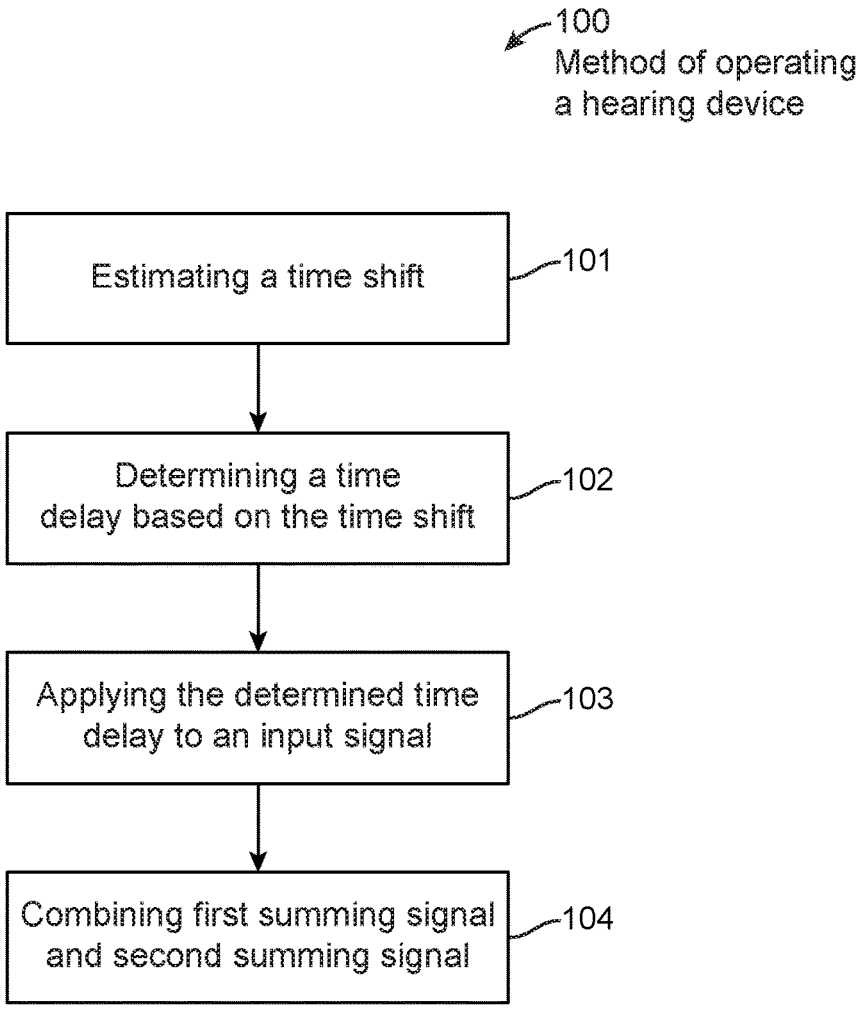
FIG. 5 shows an exemplary flowchart of a method of operating a hearing device.

FIG. 5 shows an exemplary flowchart of a method 100 of operating a hearing device. The method comprises estimating 101 a time shift between a microphone output signal (second input signal) and a transceiver output signal (first input signal). Estimating 101 a time shift may comprise determining which of the microphone output signal and the transceiver output signal is first in time. The method 100 proceeds to determining 102 a time delay based on the time shift and optionally based on which of the microphone output signal (second input signal) and the transceiver output signal (first input signal) is first in time. The time delay may take both negative and positive values, where the sign of the time delay indicates which of the microphone output signal and the transceiver output signal is first in time. The method 100 comprises applying 103 the determined time delay to an input signal to the processing unit to form a first summing signal and combining 104 the first summing signal and a second summing signal, the second summing signal being based on an input signal. The combined signal may be fed to a hearing compensator for further processing. The exemplary processing units 4, 4', 4" may be used for performing the method 100.

Figure 6A:
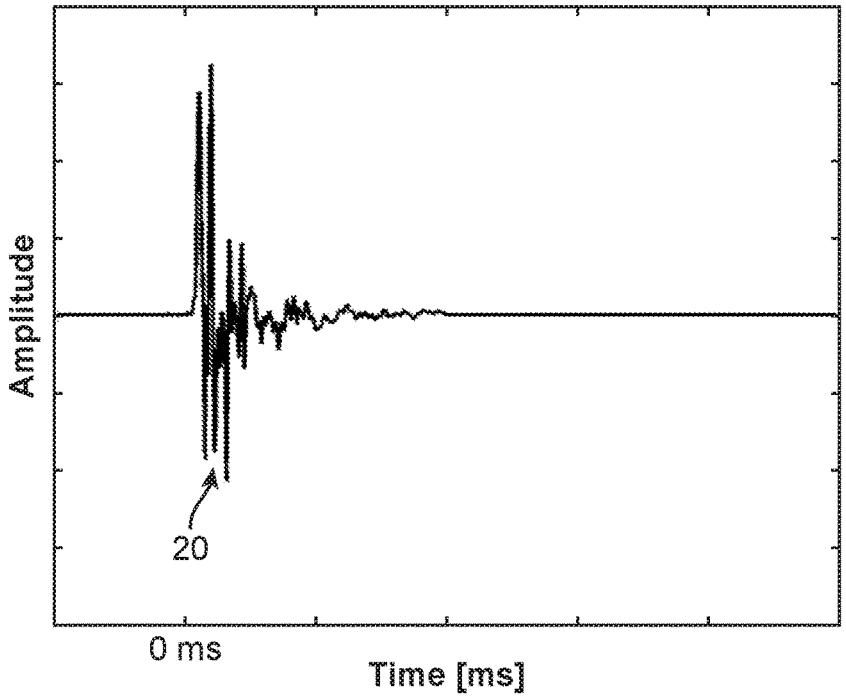
FIGS. 6*a-d* show exemplary graphs illustrating a first and a second input signal, time shift estimation, and the combined first and second summing signals.
Figure 6B:
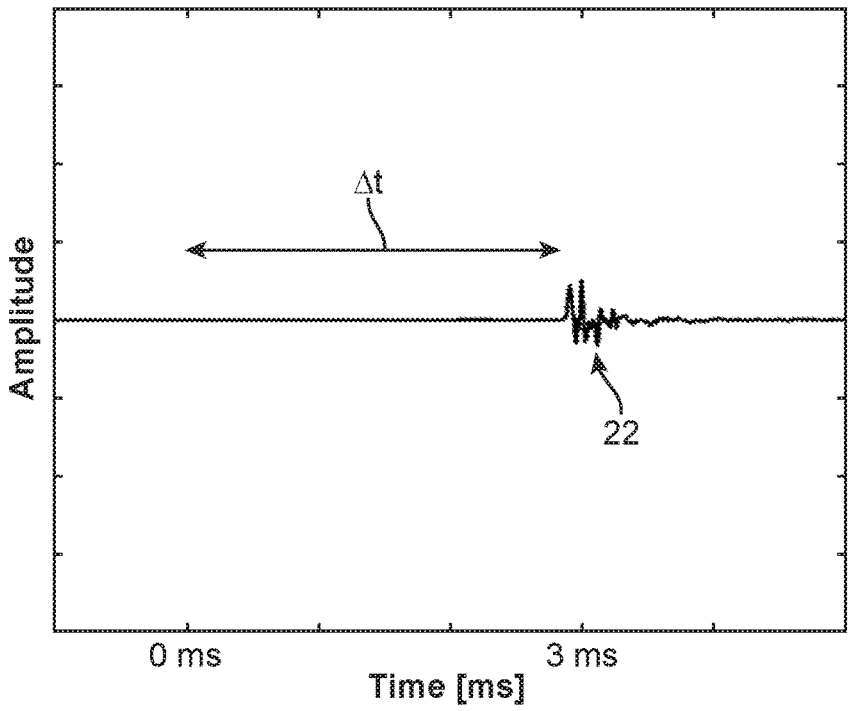
Figure 6C:
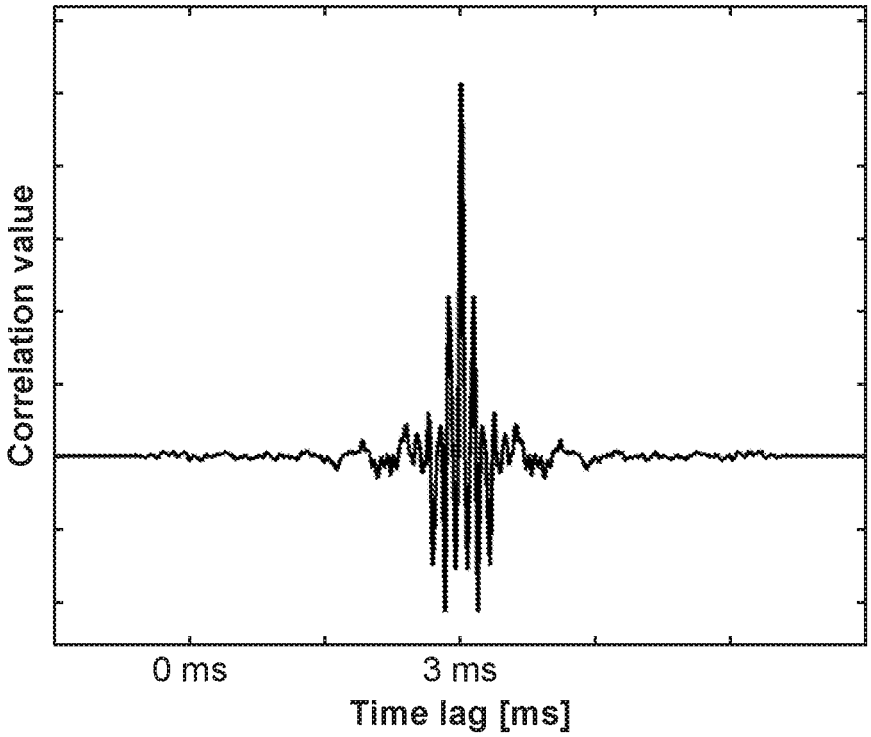
Figure 6D:
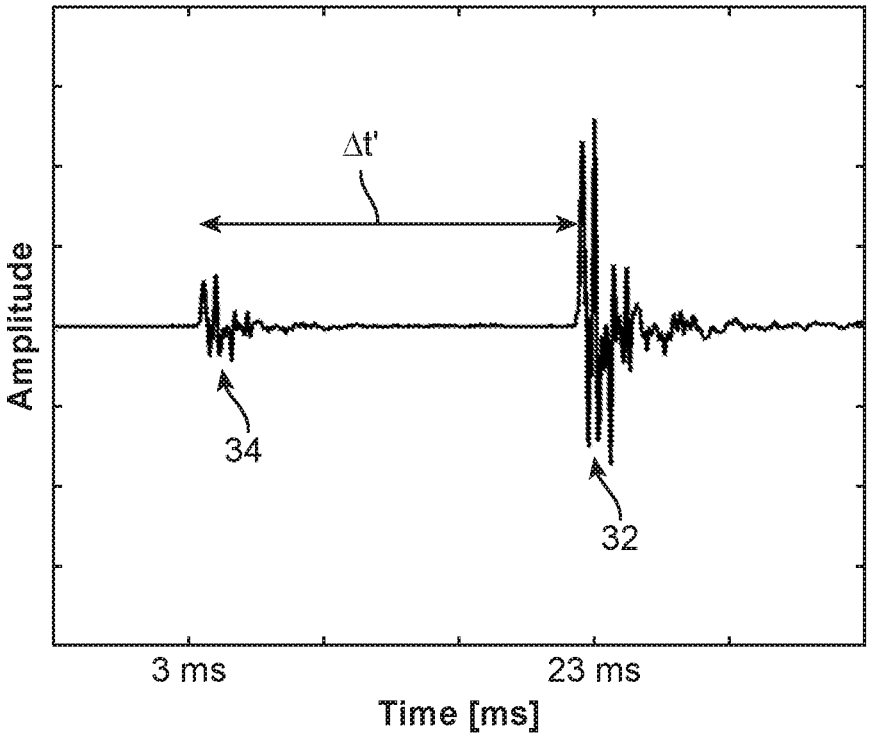

FIG. 6*a-d* shows exemplary graphs illustrating a first and a second input signal, time shift estimation in form of e.g. a cross correlation between the first and second input signals, and the combined first and second summing signals. In the x-axis time in millisecond (ms) is shown. In the y-axis amplitude of the signals/cross-correlation is shown. FIG. 6*a*) shows an example of a first input signal 20 received in a processing unit of a hearing device at time t=0 ms. A transceiver is connected to the processing unit of the hearing device, the transceiver is configured for outputting a transceiver output signal representative of a first audio signal to form the first input signal 20 to the processing unit. FIG. 6*b*) shows an example of a second input signal 22 received in the processing unit of the hearing device at a time>0 ms, e.g. at t=3 ms as shown in the graph, i.e. at a later time than the reception of the first input signal 20 in FIG. 6*a*). A microphone is connected to the processing unit for converting a second audio signal into a microphone output signal to form the second input signal 22 to the processing unit. FIG. 6*c*) shows an example of a time shift or time lag estimation, e.g. in form of a cross correlation, between the first input signal (the transceiver output signal), see FIG. 6*a*) and the second input signal (microphone output signal), see FIG. 6*b*). The time shift Δt between the first input signal and the second input signal may be selected as the time t where the cross-correlation between the first input signal and the second input signal has maximum. Accordingly as taken from FIG. 6*c*, the time shift Δt is 3 ms. A time delay D is determined (in the illustrated scenario the time delay D1 to apply to the first input signal) based on the estimated time shift Δt or time lag, e.g. D1=Δt+20 ms, where 20 ms is the desired delay between the second input signal (microphone signal) and the first input signal (transceiver signal). FIG. 6*d*) shows an example where the determined time delay D1 is applied to the first input signal, see FIG. 6*a*), to form a first summing signal 32. A second summing signal 34 is based on the second input signal, see FIG. 6*b*). The first summing signal 32 and the second summing signal 34 are combined and transmitted to the hearing compensator of the hearing device. The determined time delay between the summing signals is 20 ms as seen from FIG. 6*d*, as the time between the first summing signal 32 and the second summing signal is 20 ms.

Figure 7:
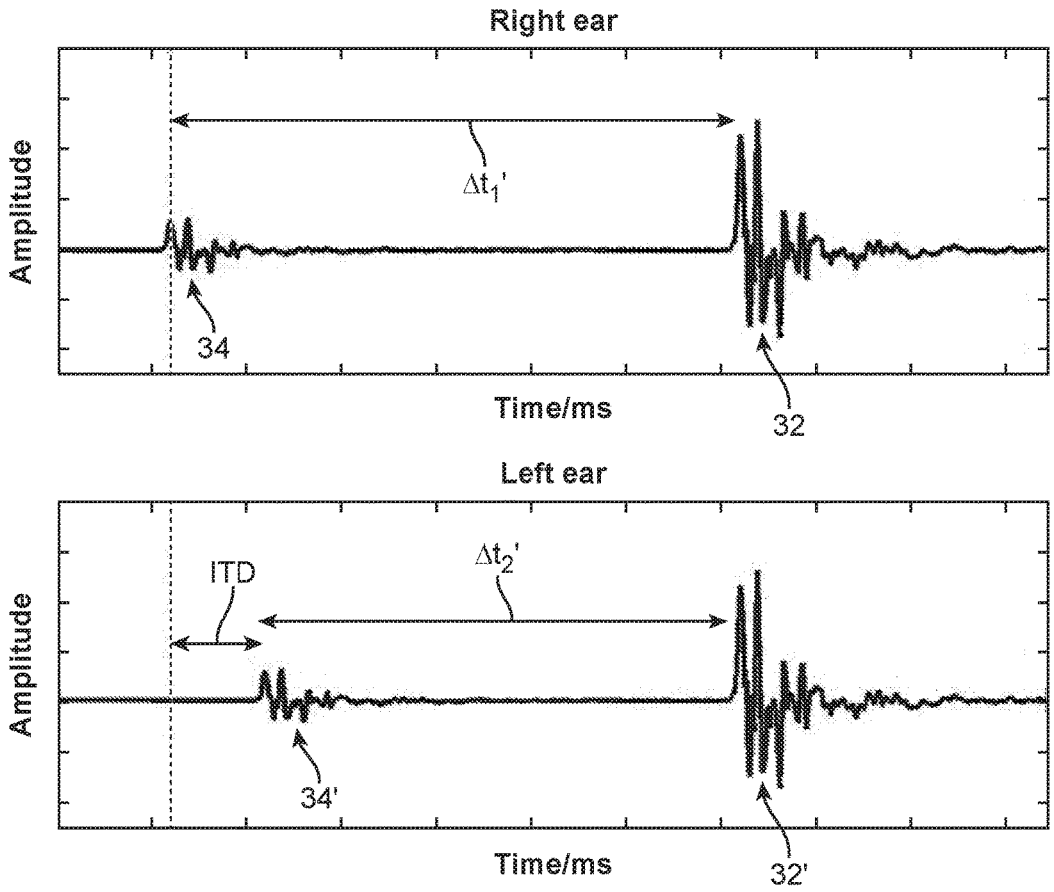
FIG. 7 shows exemplary graphs of summing signals in a binaural hearing device system.
Figure 8:
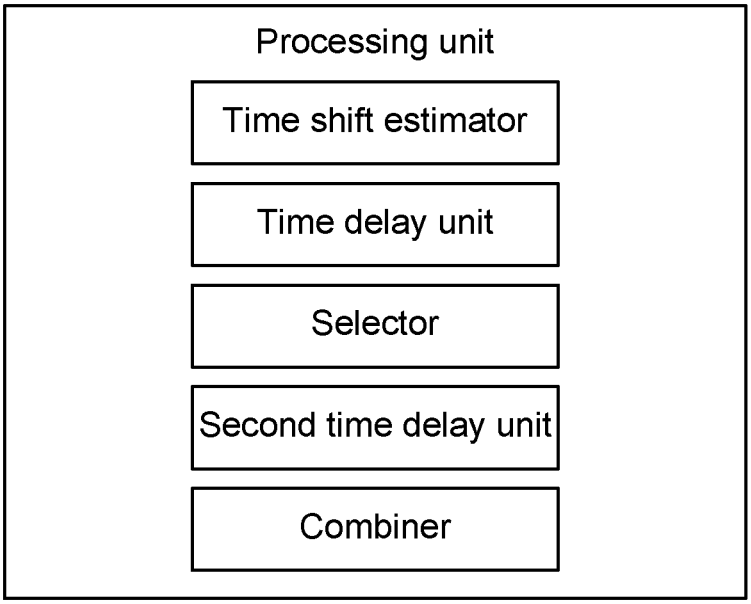
Figure 9:
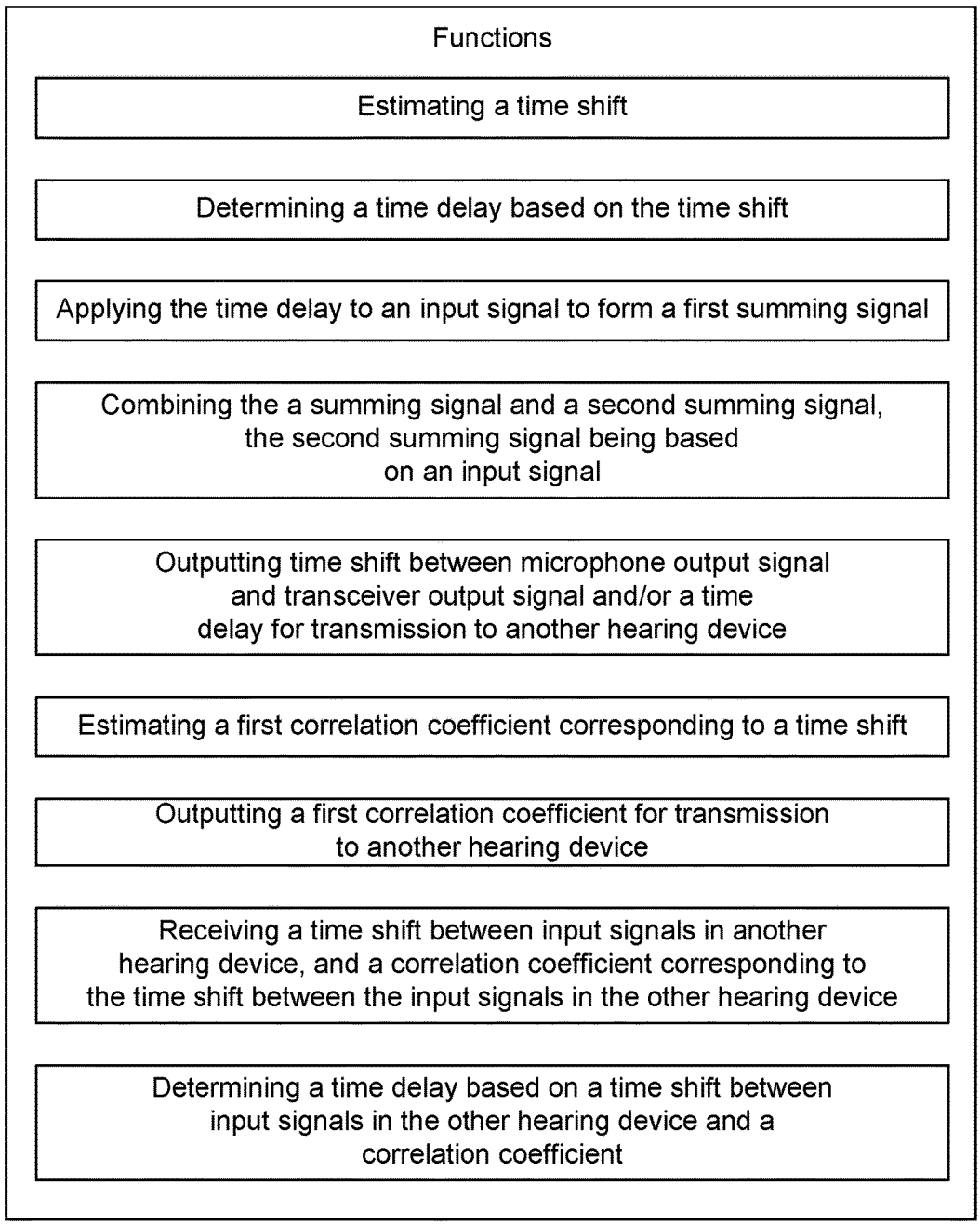
Figure 10:
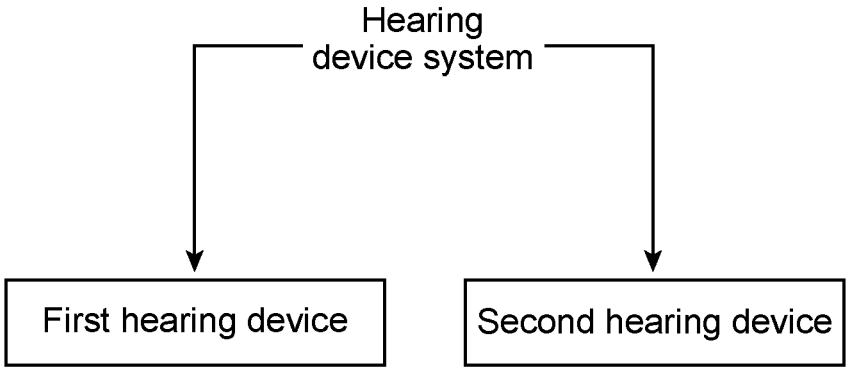

FIG. 7 shows exemplary graphs of combined summing signals in the left and right hearing devices of a binaural hearing device system. The x-axis shows time in milliseconds (ms). The y-axis shows the amplitude of the audio signals. The top graph shows first summing signal 32 and second summing signal 34 in a first hearing device (right hearing device in right ear). The bottom graph shows first summing signal 32' and second summing signal 34' in a second hearing device (left hearing device in left ear). The first summing signal 32 is based on a first input signal to the processing unit of the first hearing device, and the second summing signal 34 is based on a second input signal to the processing unit of the first hearing device. The first summing signal 32' is based on a first input signal to the processing unit of the second hearing device, and the second summing signal 34' is based on a second input signal to the processing unit of the second hearing device. The first and second input signals may be speech from a spouse to the hearing device user.

The first delay D1 and the second delay D1 applied to respective first and second input signals of the first hearing device, and the first delay D1' and the second delay D2' applied to respective first and second input signals of the second hearing device are determined (D1 and D2 in first hearing device and D1' and D2' in second hearing device, or D1, D2, D1' and D2' in one of the first and/or second hearing device) such that ITD between the second input signal of the first hearing and the second input signal of the second hearing aid are maintained between the second summing signals and such that the time shift $\Delta t_1'$ between summing signals 32 and 34 is in the range from 2-50 ms and the time shift $\Delta t_2'$ between summing signals 32' and 34' is in the range from 2-50 ms. In the example shown in the figures, the second input signal is received first in the right hearing device and subsequently received in the left hearing device. The difference in time between receiving the second input signal in the right hearing device and subsequently in the left hearing device is maintained or substantially maintained (e.g. ±5%) in the summing signals and marked in the graph of the left ear as an arrow named ITD, i.e. intra-aural time difference, indicating that this is the difference in time between the left and the right ear receiving the second input signal. The reason for the time difference, ITD, may be that the hearing device user is positioned such that his/her right ear points towards the source of the second input signal, and his/her left ear points away from the source of the second input signal 20. This may mean that the second input signal reaches the right ear some milliseconds before reaching the left ear, i.e. providing this ITD. Optionally the hearing device, e.g. in the right ear, may communicate with another hearing device, e.g. in the left ear, in a binaural hearing device system. The hearing devices of a binaural hearing device system may be hearing devices with processing unit 4' of FIG. 3, reducing the need for communication between the hearing devices and ensuring that ITD is maintained. The correlation value or correlation coefficient of the hearing device in e.g. the right ear may be determined as explained above and termed a first correlation coefficient, and this first correlation coefficient may be compared with a correlation coefficient of the other hearing device, e.g. in the left ear, termed a second correlation coefficient.

The processing unit of the hearing device in e.g. the right ear or another processing unit, e.g. in the hearing device in the left ear, may determine which of the first and the second correlation coefficient is the highest. The processing unit may then be configured to apply a determined time delay to the input signal, the time delay corresponding to the estimated time shift corresponding to the hearing device with the highest correlation coefficient. Applying this time delay will provide the best signal-to-noise ratio and thus the best final audio signal in both hearing devices, i.e. in the right and left ear, to the user. The hearing devices of a binaural hearing device system may be hearing devices with processing unit 4' of FIG. 3, reducing the need for communication between the hearing devices and at the same time ensuring that ITD is maintained.

Exemplary hearing devices and methods are set out in the following items:

Item 1. A hearing device comprising:

a processing unit;

a transceiver connected to the processing unit and being configured for outputting a transceiver output signal representative of a first audio signal to form a first input signal for the processing unit; and a microphone connected to the processing unit for converting a second audio signal into a microphone output signal to form a second input signal for the processing unit; wherein the processing unit is configured to:

estimate a time shift between the microphone output signal and the transceiver output signal;

determine a time delay based on the time shift;

apply the time delay to an input signal to the processing unit to form a first summing signal; and combine the first summing signal and a second summing signal, the second summing signal being based on an input signal to the processing unit.

Item 2. Hearing device according to item 1, wherein the second summing signal is the second input signal.

Item 3. Hearing device according to any of items 1-2, wherein the time delay is applied to the first input signal.

Item 4. Hearing device according to item 1, wherein the second summing signal is the first input signal.

Item 5. Hearing device according to item 4, wherein the time delay is applied to the second input signal.

Item 6. Hearing device according to any of items 1-5, wherein the input signal comprises one of the first input signal and the second input signal, and wherein the second summing signal comprises the other one of the first input signal and or second input signal.

Item 7. Hearing device according to any of items 1-6, wherein a time shift between the first and the second summing signals is in the range from 2-50 ms.

Item 8. Hearing device according to any of items 1-7, wherein the time shift between the microphone output signal and the transceiver output signal is estimated using at least one of cross correlation, summing of squared differences and summing of absolute differences.

Item 9. Hearing device according to any of items 1-8, wherein the processing unit is configured to transmit the time shift between the microphone output signal and the transceiver output signal and/or the time delay based on the time shift between the microphone output signal and the transceiver output signal to another hearing device.

Item 10. Hearing device according to any of items 1-9, wherein the processing unit is configured to estimate a first correlation coefficient corresponding to the time shift and transmit the first correlation coefficient to another hearing device.

Item 11. Hearing device according to any of items 1-10, wherein the processing unit is configured to receive a time shift between input signals in another hearing device and a second correlation coefficient corresponding to the time shift between input signals in the other hearing device.

Item 12. Hearing device according to item 11, wherein the processing unit is configured to determine the time delay based on the time shift between input signals in the other hearing device and the second correlation coefficient.

Item 13. Hearing device system comprising a first and second hearing device, wherein the first hearing device is a hearing device according to any of items 1-12.

Item 14. Method of operating a hearing device, the hearing device comprising a processing unit, a transceiver connected to the processing unit, and a microphone connected to the processing unit, the method comprising:

estimating a time shift between a microphone output signal and a transceiver output signal;

determining a time delay based on the time shift;

applying the time delay to an input signal to the processing unit to form a first summing signal; and combining the first summing signal and a second summing signal, the second summing signal being based on an input signal to the processing unit.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4, 4', 4" processing unit
6 transceiver
8 transceiver output signal
10 first audio signal
12 microphone
14 second audio signal
16 microphone output signal
18 receiver
19 output signal from processing unit
20 first input signal
22 second input signal
24 time shift estimator
25 time delay selector
26 control signal to first delay unit
27 control signal to second delay unit
28 first time delay unit
29 second time delay
30 second time delay unit
32, 32' first summing signal
34, 34' second summing signal
36 combiner
38 combined signal
40 hearing compensator
42 time delay unit
43 time delay control signal
100 method of operating a hearing device
101 estimating a time shift
102 determining a time delay based on the time shift
103 applying the determined time delay to an input signal
104 combining first summing signal and second summing signal
D1, D1' first delay
D2, D2' second delay
$\Delta t$ time shift between first input signal and second input signal
$\Delta t'$ time shift between first summing signal and second summing signal
$\Delta t_1'$ time shift between first summing signal and second summing signal in first hearing device
$\Delta t_2'$ time shift between first summing signal and second summing signal in second hearing device

The invention claimed is:

1. A hearing device comprising:
a processing unit;
a transceiver connected to the processing unit and being configured for outputting a transceiver output signal representative of a first audio signal to form a first input signal for the processing unit; and
a microphone connected to the processing unit for converting a second audio signal into a microphone output signal to form a second input signal for the processing unit;
wherein the processing unit is configured to:
estimate a time shift between the microphone output signal and the transceiver output signal,
determine a time delay based on the time shift, and
use the time delay to obtain a summing signal.

2. The hearing device according to claim 1, wherein the processing unit is configured to obtain the summing signal by applying the time delay to the first input signal or the second input signal to form the summing signal; and
wherein the processing unit is further configured to combine the summing signal with the first input signal or the second input signal.

3. The hearing device according to claim 2, wherein the processing unit is configured to combine the summing signal with the second input signal, not the first input signal.

4. The hearing device according to claim 2, wherein the processing unit is configured to apply the time delay to the first input signal, not the second input signal.

5. The hearing device according to claim 2, wherein the processing unit is configured to combine the summing signal with the first input signal, not the second input signal.

6. The hearing device according to claim 5, wherein the processing unit is configured to apply the time delay to the second input signal, not the first input signal.

7. The hearing device according to claim 2, wherein the processing unit is configured to apply the time delay to one of the first input signal and the second input signal, and wherein the processing unit is also configured to combine the summing signal with the other one of the first input signal and the second input signal.

8. The hearing device according to claim 1, wherein the processing unit is configured to form the summing signal by applying the time delay to an input signal received by the processing unit; and
wherein the processing unit is further configured to combine the summing signal and an additional summing signal, the additional summing signal being based on another input signal received by the processing unit.

9. The hearing device according to claim 1, wherein a time shift between the first and the second input signals is anywhere from 2 ms to 50 ms.

10. The hearing device according to claim 1, wherein the processing unit is configured to estimate the time shift between the microphone output signal and the transceiver output signal using cross correlation, summing of squared differences, summing of absolute differences, or any combination of the foregoing.

11. The hearing device according to claim 1, wherein the processing unit is configured to output the time shift between the microphone output signal and the transceiver output signal and/or the time delay for transmission to another hearing device.

12. The hearing device according to claim 1, wherein the processing unit is configured to estimate a first correlation coefficient corresponding to the time shift, and output the first correlation coefficient for transmission to another hearing device.

13. The hearing device according to claim 1, wherein the processing unit is configured to receive a time shift between input signals in another hearing device, and a correlation coefficient corresponding to the time shift between the input signals in the other hearing device.

14. A hearing device system comprising a first hearing device and a second hearing device, wherein the first hearing device is the hearing device of claim 1.

15. The hearing device of claim 1, wherein the processing unit is configured to determine the time delay after the time shift has been estimated.

16. The hearing device of claim 1, wherein the time delay is different from the time shift.

17. A hearing device comprising:
a processing unit;
a transceiver connected to the processing unit and being configured for outputting a transceiver output signal representative of a first audio signal to form a first input signal for the processing unit; and a microphone connected to the processing unit for converting a second audio signal into a microphone output signal to form a second input signal for the processing unit;

wherein the processing unit is configured to:

estimate a time shift between the microphone output signal and the transceiver output signal, determine a time delay based on the time shift, and use the time delay to obtain a summing signal;

wherein the processing unit is configured to receive a time shift between input signals in another hearing device, and a correlation coefficient corresponding to the time shift between the input signals in the other hearing device; and wherein the processing unit is configured to determine the time delay based on the time shift between the input signals in the other hearing device and the correlation coefficient.

18. A method of operating a hearing device, the hearing device comprising a processing unit, a transceiver connected to the processing unit, and a microphone connected to the processing unit, the method comprising:

estimating a time shift between a microphone output signal and a transceiver output signal;

determining a time delay based on the time shift; and using the time delay to obtain a summing signal.

19. The method of claim 18, wherein the time delay is determined after the time shift is estimated.

20. The method of claim 18, wherein the time delay is different from the time shift.

21. A hearing device comprising:

a processing unit;

a transceiver connected to the processing unit and being configured for outputting a transceiver output signal representative of a first audio signal to form a first input signal for the processing unit; and a microphone connected to the processing unit for converting a second audio signal into a microphone output signal to form a second input signal for the processing unit;

wherein the processing unit is configured to:

estimate a time shift between the microphone output signal and the transceiver output signal, determine a time delay based on the time shift, wherein the time delay is greater than the time shift, and delay the first input signal by the time delay.

22. The hearing device of claim 21, further comprising a receiver configured to output a signal based on the second input signal and the delayed first input signal.

23. A hearing device comprising: a processing unit; a transceiver connected to the processing unit and being configured for outputting a transceiver output signal representative of a first audio signal to form a first input signal for the processing unit; and a microphone connected to the processing unit for converting a second audio signal into a microphone output signal to form a second input signal for the processing unit; wherein the processing unit is configured to: determine a first time delay and a second time delay; delay the first input signal by the first time delay to obtain a delayed first input signal. and delay the second input signal by the second time delay to obtain a delayed second input signal, wherein the first time delay and the second time delay are such that the delayed second input signal is before the delayed first input signal in time and wherein a time shift between the delayed first input signal and the delayed second input signal is within a prescribed range.

24. The hearing device of claim 23, wherein the time shift is anywhere from 2 ms to 50 ms.

25. The hearing device of claim 23, further comprising a receiver configured to output a signal based on the delayed first input signal and the delayed second input signal.

* * * * *